US008295967B2

(12) United States Patent
Zhang et al.

(10) Patent No.: US 8,295,967 B2
(45) Date of Patent: Oct. 23, 2012

(54) ENDPOINT CONTROL OF MULTIPLE-WAFER CHEMICAL MECHANICAL POLISHING

(75) Inventors: Jimin Zhang, San Jose, CA (US); Thomas H. Osterheld, Mountain View, CA (US); Ingemar Carlsson, Milpitas, CA (US); Boguslaw A. Swedek, Cupertino, CA (US); Stephen Jew, San Jose, CA (US)

(73) Assignee: Applied Materials, Inc., Santa Clara, CA (US)

( * ) Notice: Subject to any disclaimer, the term of this patent is extended or adjusted under 35 U.S.C. 154(b) by 637 days.

(21) Appl. No.: 12/267,434

(22) Filed: Nov. 7, 2008

(65) Prior Publication Data

US 2010/0120330 A1 May 13, 2010

(51) Int. Cl.
*G06F 19/00* (2011.01)

(52) U.S. Cl. ..... 700/121; 700/101

(58) Field of Classification Search ..... 700/121, 700/160, 164, 174, 175, 108–110; 118/50.1, 118/49.1, 320, 319; 156/345.12; 438/65, 438/5, 7, 9, 16; 415/5–8, 15, 63, 285–288
See application file for complete search history.

(56) References Cited

U.S. PATENT DOCUMENTS 4,185,585 A * 1/1980 Shambelan ..... 118/50.1
5,140,774 A * 8/1992 Onodera ..... 451/292
5,191,738 A * 3/1993 Nakazato et al. ..... 451/41
5,486,129 A 1/1996 Sandhu et al.
5,498,199 A 3/1996 Karlsrud et al.
5,733,650 A * 3/1998 Christensen ..... 428/328
5,916,012 A * 6/1999 Pant et al. ..... 451/41
5,951,373 A * 9/1999 Shendon et al. ..... 451/41
6,618,130 B2 9/2003 Chen
6,689,691 B2 * 2/2004 Lahnor ..... 438/690
6,913,511 B2 * 7/2005 Wiswesser et al. ..... 451/5
6,939,198 B1 * 9/2005 Swedek et al. ..... 451/5
6,966,816 B2 * 11/2005 Swedek et al. ..... 451/5
7,018,271 B2 3/2006 Wiswesser et al.
7,175,505 B1 * 2/2007 Ko et al. ..... 451/5
7,409,260 B2 * 8/2008 David et al. ..... 700/160
7,444,198 B2 * 10/2008 Ravid et al. ..... 700/117
7,764,377 B2 * 7/2010 Benvegnu et al. ..... 356/390
2002/0025764 A1 2/2002 Katsuoka et al.
2002/0151259 A1 * 10/2002 Hirokawa et al. ..... 451/285
2005/0173259 A1 * 8/2005 Mavliev et al. ..... 205/645
2006/0043071 A1 3/2006 Lee et al.
2007/0224915 A1 9/2007 David et al.
2008/0051009 A1 2/2008 Wang et al.
2010/0120331 A1 5/2010 Carlsson et al.

OTHER PUBLICATIONS

Lee, Chang Yong, Authorized Officer, International Search Report and the Written Opinion in PCT/US2009/062433 mailed May 24, 2010, 14 pages.

* cited by examiner

*Primary Examiner* — Kidest Bahta
(74) *Attorney, Agent, or Firm* — Fish & Richardson P.C.

(57) ABSTRACT

A computer-implemented method includes polishing substrates simultaneously in a polishing apparatus. Each substrate has a polishing rate independently controllable by an independently variable polishing parameter. Measurement data that varies with the thickness of each of the substrates is acquired from each of the substrates during polishing with an in-situ monitoring system. A projected thickness that each substrate will have at a target time is determined based on the measurement data. The polishing parameter for at least one substrate is adjusted to adjust the polishing rate of the at least one substrate such that the substrates have closer to the same thickness at the target time than without the adjustment.

25 Claims, 4 Drawing Sheets

ENDPOINT CONTROL OF MULTIPLE-WAFER CHEMICAL MECHANICAL POLISHING

BACKGROUND

The present relates generally to monitoring of multiple substrates during chemical mechanical polishing.

An integrated circuit is typically formed on a substrate by the sequential deposition of conductive, semiconductive, or insulative layers on a silicon wafer. One fabrication step involves depositing a filler layer over a non-planar surface and planarizing the filler layer. For certain applications, the filler layer is planarized until the top surface of a patterned layer is exposed. A conductive filler layer, for example, can be deposited on a patterned insulative layer to fill the trenches or holes in the insulative layer. After planarization, the portions of the conductive layer remaining between the raised pattern of the insulative layer form vias, plugs, and lines that provide conductive paths between thin film circuits on the substrate. For other applications, such as oxide polishing, the filler layer is planarized until a predetermined thickness is left over the non planar surface. In addition, planarization of the substrate surface is usually required for photolithography.

Chemical mechanical polishing (CMP) is one accepted method of planarization. This planarization method typically requires that the substrate be mounted on a carrier or polishing head. The exposed surface of the substrate is typically placed against a rotating polishing disk pad or belt pad. The polishing pad can be either a standard pad or a fixed abrasive pad. A standard pad has a durable roughened surface, whereas a fixed-abrasive pad has abrasive particles held in a containment media. The carrier head provides a controllable load on the substrate to push it against the polishing pad. A polishing liquid, such as a slurry with abrasive particles, is typically supplied to the surface of the polishing pad.

One problem in CMP is using an appropriate polishing rate to achieve a desirable wafer profile, e.g., a wafer that includes a substrate layer that has been planarized to a desired flatness or thickness, or a desired amount of material has been removed. Overpolishing (removing too much) of a conductive layer or film leads to increased circuit resistance. On the other hand, underpolishing (removing too little) of a conductive layer leads to electrical shorting. If multiple wafers are to be polished, it can be difficult to control the thickness across wafers. Variations in the initial thickness of a substrate layer, the slurry composition, the polishing pad condition, the relative speed between the polishing pad and a substrate, and the load on a substrate can cause variations in the material removal rate across substrates.

SUMMARY

In general, in one aspect, a computer-implemented method includes polishing a plurality of substrates simultaneously in a polishing apparatus. Each substrate has a polishing rate independently controllable by an independently variable polishing parameter. Measurement data that varies with the thickness of each of the substrates is acquired from each of the substrates during polishing with an in-situ monitoring system. A projected thickness that each substrate will have at a target time is determined based on the measurement data. The polishing parameter for at least one substrate is adjusted to adjust the polishing rate of the at least one substrate such that the substrates have closer to the same thickness at the target time than without the adjustment.

This and other embodiments can optionally include one or more of the following features. Determining the projected thickness that each substrate will have at the target time can include calculating the current polishing rate. Acquiring measurement data can include obtaining a sequence of thickness measurements. Calculating the current polishing rate can include fitting a linear function to the sequence of thickness measurements, and determining the projected thickness can include extrapolating when the linear function will reach the target time.

Acquiring measurement data may include acquiring measurement data with an eddy current monitoring system. When an eddy current monitoring system is used, polishing may be halted upon detection of a polishing endpoint with a laser monitoring system.

Acquiring measurement data can include acquiring measurement data with an optical monitoring system. A sequence of current spectra of reflected light can be acquired from the substrate. Each current spectra from the sequence of current spectra can be compared to a plurality of reference spectra from a reference spectra library, and a best-match reference spectra can be selected.

The polishing parameter may be a pressure in the carrier head of the polishing apparatus, the rotation rate of the carrier head, or the rotation rate of the platen of the polishing apparatus.

Adjusting the polishing parameter can include selecting a reference substrate and adjusting the polishing parameter of a different substrate. Adjusting the polishing parameter of the different substrate can include adjusting the polishing rate of the different substrate such that the different substrate has approximately the projected thickness of the reference substrate at the target time. Selecting a reference substrate may include selecting a predetermined substrate. Selecting a reference substrate may include selecting a substrate having the thinnest projected thickness or the thickest projected thickness.

Adjusting the polishing parameter may include calculating an average thickness from the projected thickness for each substrate. Adjusting the polishing parameter may include adjusting the polishing parameters of the substrates such that the substrates have approximately the average thickness at the target time. The substrates can be polished at the same platen.

In other aspects, polishing systems and computer-program products tangibly embodied on a computer readable medium are provided to carry out these methods.

Certain implementations may have one or more of the following advantages. When all of the wafers on the same platen endpoint at approximately the same time, defects can be avoided, such as scratches caused by rinsing a substrate with water too early or corrosion caused by failing to rinse a substrate in a timely manner. Equalizing polishing times across multiple substrates can also improve throughput.

The details of one or more embodiments of the invention are set forth in the accompanying drawings and the description below. Other features, aspects, and advantages of the invention will become apparent from the description, the drawings, and the claims.

BRIEF DESCRIPTION OF THE DRAWINGS

Like reference numbers and designations in the various drawings indicate like elements.

DETAILED DESCRIPTION

Where multiple substrates are being polished simultaneously, e.g., on the same polishing pad, polishing rate variations between the substrates can lead to the substrates reaching their target thickness at different times. On the one hand, if polishing is halted simultaneously for the substrates, then some will not be at the desired thickness. On the other hand, if polishing for the substrates is stopped at different times, then some substrates may have defects and the polishing apparatus is operating at lower throughput.

By determining a polishing rate for each substrate from in-situ measurements, a projected endpoint time for a target thickness or a projected thickness for target endpoint time can be determined for each substrate, and the polishing rate for at least one substrate can be adjusted so that the substrates achieve closer endpoint conditions. By "closer endpoint conditions," it is meant that the substrates would reach their target thickness closer to the same time than without such adjustment, or if the substrates halt polishing at the same time, that the substrates would have closer to the same thickness than without such adjustment.

Figure 1:
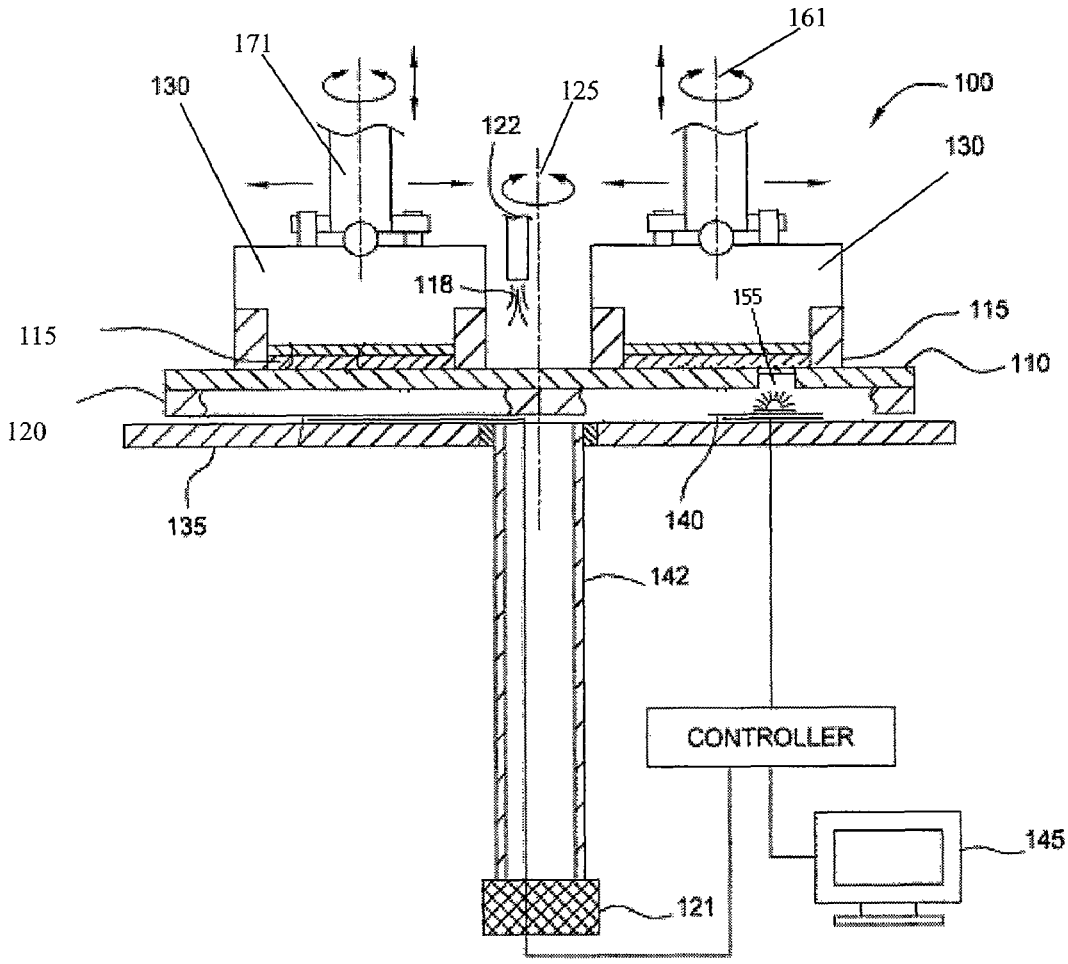
FIG. 1 illustrates an example of a polishing apparatus having two polishing heads.

FIG. 1 illustrates an example of a polishing apparatus 100. The polishing apparatus 100 includes a rotatable disk-shaped platen 120 on which a polishing pad 110 is situated. The platen is operable to rotate about an axis 125. For example, a motor 121 can turn a drive shaft 142 to rotate the platen 120.

The polishing apparatus 100 includes a combined slurry/rinse arm 122. During polishing, the arm 122 is operable to dispense a polishing liquid 118, such as a slurry, onto the polishing pad 110.

In this embodiment, the polishing apparatus 100 includes two carrier heads 130. Each carrier head 130 is operable to hold a substrate 115 against the polishing pad 110. Each carrier head 130 can have independent control of the polishing parameters, for example pressure, associated with each respective substrate.

Each carrier head 130 is suspended from a support structure 171 and is connected by a drive shaft to a carrier head rotation motor so that the carrier head can rotate about an axis 161. In addition, each carrier head 130 can oscillate laterally. In operation, the platen is rotated about its central axis 125, and each carrier head is rotated about its central axis 161 and translated laterally across the top surface of the polishing pad.

While only two carrier heads 130 are shown, more carrier heads can be provided to hold additional substrates so that the surface area of polishing pad 110 may be used efficiently. Thus, the number of carrier head assemblies adapted to hold substrates for a simultaneous polishing process can be based, at least in part, on the surface area of the polishing pad 110. While only one slurry/rinse arm 122 is shown, additional nozzles, such as one or more dedicated slurry arms per carrier head, can be used.

The polishing apparatus also includes an in-situ monitoring system 140, which can be used to determine whether to adjust a polishing rate or an adjustment for the polishing rate as discussed below. The in-situ monitoring system 140 can include an optical monitoring system, e.g., a laser or spectrographic monitoring system, or an eddy current monitoring system.

In one embodiment, the monitoring system is an optical monitoring system. An optical access 155 through the polishing pad is provided by including an aperture (i.e. a hole that runs through the pad) or a solid window. The optical monitoring system can include one or more of the following (not shown): a light source, a light detector, and circuitry for sending and receiving signals to and from the light source and light detector.

Light can then pass from the light source, through the optical access 155 in the polishing pad 110, impinge, and reflect from the substrate 115, back through the optical access 155, and to the light detector. For example, the output of the detector can be a digital electronic signal that passes through a rotary coupler, e.g., a slip ring, in the drive shaft 142 to a controller 145, such as a computer, for the optical monitoring system. Similarly, the light source can be turned on or off in response to control commands in digital electronic signals that pass from the controller through the rotary coupler to the monitoring system.

The light source can be operable to emit white light. In one implementation, the white light emitted includes light having wavelengths of 200-800 nanometers. A suitable light source is a xenon lamp or a xenon mercury lamp.

The light detector can be a spectrometer. A spectrometer is an optical instrument for measuring intensity of light over a portion of the electromagnetic spectrum. A suitable spectrometer is a grating spectrometer. Typical output for a spectrometer is the intensity of the light as a function of wavelength (or frequency).

The light source and light detector can be connected to a computing device, e.g., a controller, operable to control their operation and receive their signals. The computing device can include a microprocessor situated near the polishing apparatus, e.g., a programmable computer. With respect to control, the computing device can, for example, synchronize activation of the light source with the rotation of the platen 120.

In some embodiments, the sensor of the in-situ monitoring system are installed in and rotate with the platen 120. In this case, the motion of the platen will cause the sensor to scan across the substrate. In other embodiments, particularly for an optical monitoring system, the sensor of the in-situ monitoring system is stationary and positioned below the substrate. In this case, the in-situ monitoring system make a measurement each time that an aperture through the platen is aligned with the sensor to permit optical access to the substrate.

In the case of an optical monitoring system, as the platen rotates, the computing device can cause the light source to emit a series of flashes starting just before and ending just after the substrate 115 passes over the in-situ monitoring module or the aperture in the platen is aligned with the sensor of the in-situ monitoring module. Alternatively, the computing device can cause the light source to emit light continuously starting just before and ending just after the substrate 115 passes over the in-situ monitoring module or the aperture in the platen is aligned with the sensor of the in-situ monitoring module. In either case, the signal from the detector can be integrated over a sampling period to generate spectra measurements at a sampling frequency. Where the sensor is installed in the platen, each time one of the substrates 115 passes over the monitoring module, the alignment of the substrate with the monitoring module can be different than in the previous pass. Over one rotation of the platen, spectra are obtained from different radii on the substrate. That is, some spectra are obtained from locations closer to the center of the substrate and some are closer to the edge. In addition, over multiple rotations of the platen, a sequence of spectra can be obtained over time.

In operation, the computing device can receive, for example, a signal that carries information describing a spectrum of the light received by the light detector for a particular flash of the light source or time frame of the detector. Thus, this spectrum is a spectrum measured in-situ during polishing.

Without being limited to any particular theory, the spectrum of light reflected from the substrate 115 evolves as polishing progresses due to changes in the thickness of the outermost layer, thus yielding a sequence of time-varying spectra. Moreover, particular spectra are exhibited by particular thicknesses of the layer stack.

In some implementations, the computing device can include a comparison module that compares the measured spectra to multiple reference spectra to generate a sequence of best-match reference spectra, and determines a goodness of fit for the sequence of best-match reference spectra. As used herein, a reference spectrum is a predefined spectrum generated prior to polishing of the substrate. A reference spectrum can have a pre-defined association, i.e., defined prior to the polishing operation, with a value of a substrate property, such as a thickness of the outermost layer. Alternatively or in addition, the reference spectrum can have a pre-defined association with value representing a time in the polishing process at which the spectrum is expected to appear, assuming that the actual polishing rate follows an expected polishing rate.

A reference spectrum can be generated empirically, e.g., by measuring the spectrum from a test substrate having a known layer thicknesses, or generated from theory. For example, to determine a reference spectrum, a spectrum of a "set-up" substrate with the same pattern as the product substrate can be measured pre-polish at a metrology station. A substrate property, e.g., the thickness of the outermost layer, can be also be measured pre-polish with the same metrology station or a different metrology station. The set-up substrate is then polished while spectra are collected. For each spectrum, a value is recorded representing the time in the polishing process at which the spectrum was collected. For example, the value can be an elapsed time, or a number of platen rotations. The substrate can be overpolished, i.e., polished past a desired thickness, so that the spectrum of the light that reflected from the substrate when the target thickness is achieved can be obtained. The spectrum and property, e.g., thickness of the outermost layer, of the set-up substrate can then be measured post-polish at a metrology station.

In addition to being determined empirically, some or all of the reference spectra can be calculated from theory, e.g., using an optical model of the substrate layers. For example, and optical model can be used to calculate a spectrum for a given outer layer thickness D. A value representing the time in the polishing process at which the spectrum would be collected can be calculated, e.g., by assuming that the outer layer is removed at a uniform polishing rate. For example, the time Ts for a particular spectrum can be calculated simply by assuming a starting thickness D0 and uniform polishing rate R (Ts=(D0−D)/R). As another example, linear interpolation between measurement times T1, T2 for the pre-polish and post-polish thicknesses D1, D2 (or other thicknesses measured at the metrology station) based on the thickness D used for the optical model can be performed (Ts=T2−T1*(D1−D)/(D1−D2)).

As used herein, a library of reference spectra is a collection of reference spectra which represent substrates that share a property in common. However, the property shared in common in a single library may vary across multiple libraries of reference spectra. For example, two different libraries can include reference spectra that represent substrates with two different underlying thicknesses.

Spectra for different libraries can be generated by polishing multiple "set-up" substrates with different substrate properties (e.g., underlying layer thicknesses, or layer composition) and collecting spectra as discussed above; the spectra from one set-up substrate can provide a first library and the spectra from another substrate with a different underlying layer thickness can provide a second library. Alternatively or in addition, reference spectra for different libraries can be calculated from theory, e.g., spectra for a first library can be calculated using the optical model with the underlying layer having a first thickness, and spectra for a second library can be calculated using the optical model with the underlying layer having a different one thickness.

In some implementations, each reference spectrum is assigned an index value. This index can be the value representing the time in the polishing process at which the reference spectrum is expected to be observed. The spectra can be indexed so that each spectrum in a particular library has a unique index value. The indexing can be implemented so that the index values are sequenced in an order in which the spectra were measured. An index value can be selected to change monotonically, e.g., increase or decrease, as polishing progresses. In particular, the index values of the reference spectra can be selected so that they form a linear function of time or number of platen rotations. For example, the index values can be proportional to a number of platen rotations. Thus, each index number can be a whole number, and the index number can represent the expected platen rotation at which the associated spectrum would appear.

The reference spectra and their associated indices can be stored in a library. The library can be implemented in memory of the computing device of the polishing apparatus.

During polishing, an index trace can be generated for each library. Each index trace includes a sequence of indices that form the trace, each particular index of the sequence associated with a particular measured spectrum. For the index trace of a given library, a particular index in the sequence is generated by selecting the index of the reference spectrum from the given library that is the closest fit to a particular measured spectrum. Thus, each current spectrum from the sequence of current spectra is compared to a plurality of reference spectra from a reference spectra library to generate a sequence of best-match reference spectra. More generally, for each current spectrum, the reference spectrum that is the best match to the current spectrum is determined.

Where there are multiple current spectra, a best match can be determined between each of the current spectra and each of the reference spectra of a given library. Each selected current spectra is compared against each reference spectra. Given current spectra e, f, and g, and reference spectra E, F, and G, for example, a matching coefficient could be calculated for each of the following combinations of current and reference spectra: e and E, e and F, e and G, f and E, f and F, f and G, g and E, g and F, and g and G. Whichever matching coefficient indicates the best match, e.g., is the smallest, determines the reference spectrum, and thus the index.

In another embodiment, the monitoring system is an eddy current monitoring system. The eddy coil monitoring system can include one or more of the following (not shown): a drive coil for generating an oscillating magnetic field, which may couple with the conductive region of interest on the substrate 115 such as a portion of metal layer on a semiconductor wafer. The drive coil is wound around a core (not shown) which may be formed of a ferrite material such as a MnZn or NiZn ferrite.

The oscillating magnetic field generates eddy currents locally in the conductive region of the substrate 115. The eddy currents cause the conductive region of the substrate to act as an impedance source in parallel with a sense coil and a capacitor (not shown). As the thickness of the conductive region of the substrate changes, the impedance changes, resulting in a change in the Q-factor of the system. By detecting the change in the Q-factor, the eddy current sensing mechanism can sense the change in the strength of the eddy currents, and thus the change in the thickness of the conductive region. Therefore, eddy current systems may be used to determine parameters of the conductive region, such as a thickness of the conductive region, or may be used to determine related parameters, such as a polishing endpoint. Note that although the thickness of a particular conductive region is discussed above, the relative position of the core and the conductive layer may change, so that thickness information for a number of different conductive regions is obtained. Likewise, although the thickness of a particular substrate is disclosed, multiple substrates located on the same platen may be monitored.

In some implementations, a change in Q-factor may be determined by measuring an eddy current amplitude as a function of time, for a fixed drive frequency and amplitude. An eddy current signal may be rectified using a rectifier, and the amplitude monitored via an output. Alternatively, a change in Q-factor may be determined by measuring an eddy current phase as a function of time.

The monitoring system can include other sensor elements, including, for example, lasers, light emitting diodes, and photodetectors.

Figure 2A:
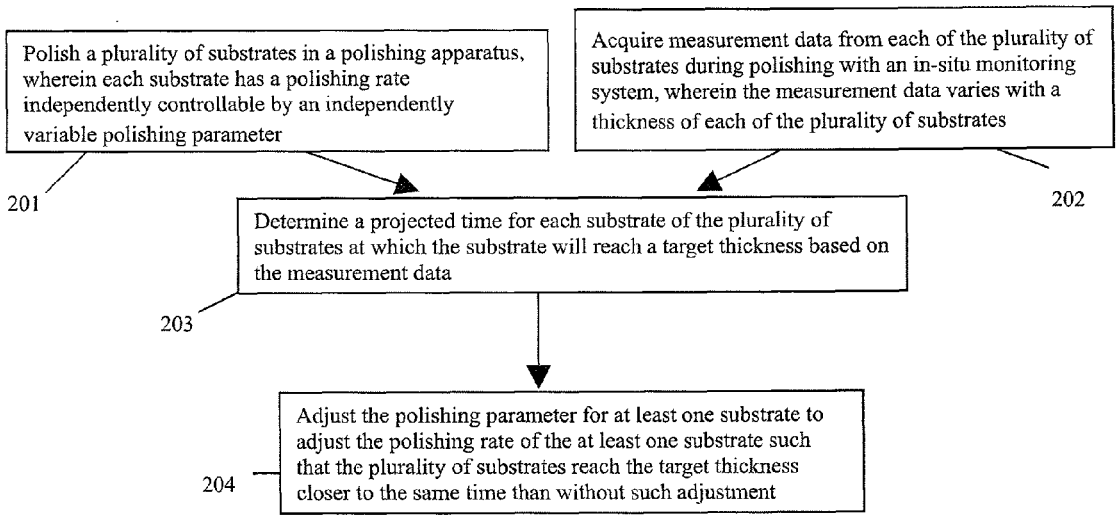
FIG. 2A is a flow diagram of an example process for adjusting the polishing rate of a substrate in a plurality of substrates such that the plurality of substrates reach the target thickness at approximately the same time.
Figure 2B:
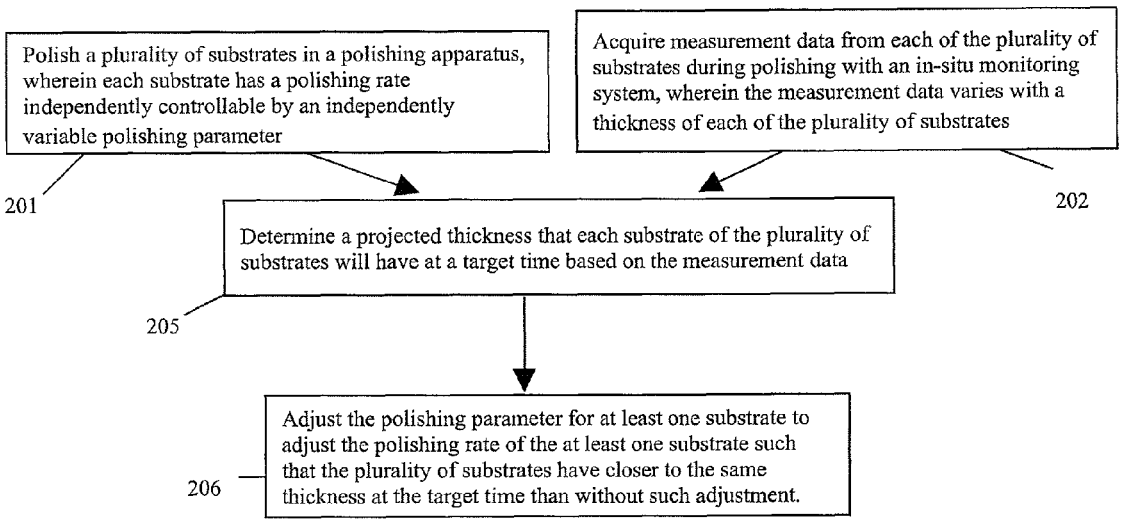
FIG. 2B is a flow diagram of an example process for adjusting the polishing rate of a substrate in a plurality of substrates such that the plurality of substrates have approximately the same thickness at the target time.

In some implementations, the measurement data gathered by the monitoring system, for example the current spectra or eddy current data, can be gathered from a plurality of substrates. Referring to FIGS. 2A and 2B, a plurality of substrates are polished in a polishing apparatus simultaneously with the same polishing pad, as described above. During this polishing operation, each substrate has its polishing rate controllable independently of the other substrates by an independently variable polishing parameter, e.g., the pressure applied by the carrier head holding the particular substrate (step 201). During the polishing operation, the substrates are monitored (step 202) as described above. In one embodiment, as shown in FIG. 2A, a projected time at which each substrate will reach a target thickness is determined (step 203). The polishing parameter for at least one substrate is adjusted to adjust the polishing rate of that substrate such that the plurality of substrates reach the target thickness at approximately the same time (step 204). In another embodiment, as shown in FIG. 2B, a projected thickness that each substrate will have at a target time is determined (step 205). The polishing parameter for at least one substrate is adjusted to adjust the polishing rate of that substrate such that the plurality of substrate have approximately the same thickness at the target time (step 206).

Figure 3:
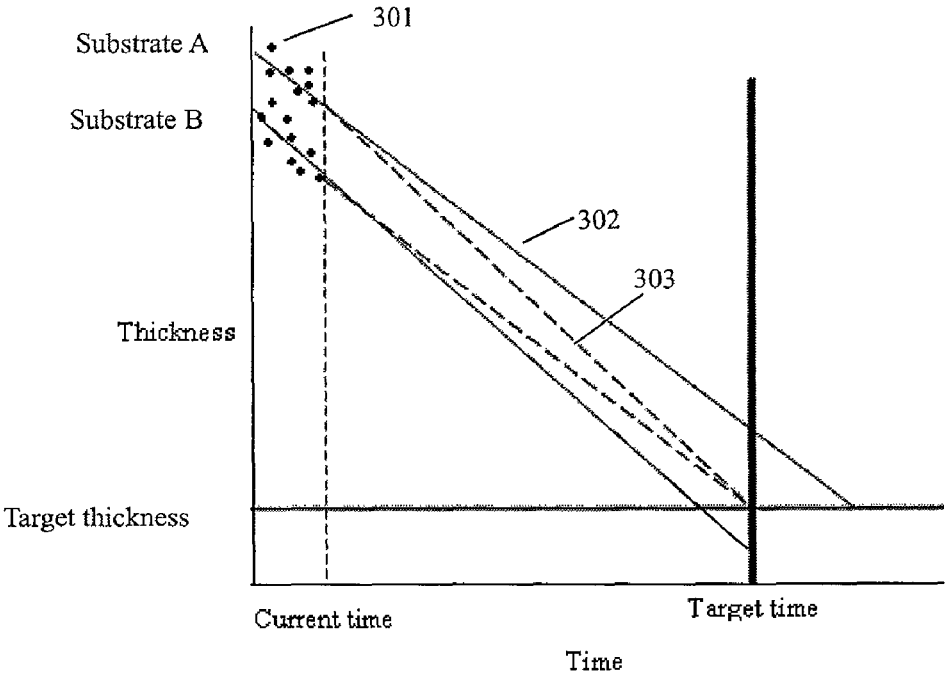
FIG. 3 illustrates an example graph of polishing progress, measured in thickness, versus time for a process in which the polishing rates are adjusted to reach a target time or thickness.

As shown in FIG. 3, the measured thicknesses (represented by points 301), for example gathered with an eddy current monitoring system, can be plotted according to time for each substrate. For each substrate, a polynomial function of known order, e.g., a first-order function (i.e., a line 302) is fit to the collected thickness measurements of that substrate, e.g., using robust line fitting.

In order to determine the projected time at which a substrate will reach a target thickness, the intersection of the line 301 with the target thickness can be calculated. The endpoint time can be calculated based on the polishing rate PR, the pre polish starting thickness of the substrate, ST, and the target thickness, TT (the polishing rate PR and starting thickness ST are given by the results of the fitting the function to the collected thickness measurements, whereas the target thickness is set by the user prior to the polishing operation and stored). The endpoint time can be calculated as a simple linear interpolation, assuming that the polishing rate is constant through the polishing process, e.g., endpoint time, Et=(ST−TT)/PR.

In addition, where the line meets a target time at which polishing will halt defines a projected endpoint thickness. The rate of change of the thickness for each substrate can thus be used to extrapolate the thickness to determine the thickness that will be achieved at the expected endpoint time for the associated substrate.

As shown in FIG. 3, if no adjustments are made to the polishing rate of any of the substrates at the current time, then each substrate could have a different endpoint time (which is not desirable because it can lead to defects and loss of throughput) or if endpoint is forced at the same time for all substrates, then each substrate can have a different thickness. Here, for example, substrate A would endpoint at a greater thickness than substrate B. Likewise, if both substrates were polished until the same target thickness, then substrate A would require an endpoint time that is later than the endpoint time of substrate B.

If, as shown in FIG. 3, the desired thickness will be reached at different times for different substrates, the polishing rate can be adjusted upwardly or downwardly, such that the substrates would reach the target thickness closer to the same time than without such adjustment, e.g., at approximately the same time, or would have closer to the same thickness, e.g., the target thickness, at the target time than without such adjustment, e.g., approximately the same thickness.

Thus, for example, in FIG. 3, commencing at a time T1, the polishing parameters for substrate A are modified so that the polishing rate of substrate A is increased, and the polishing rate of substrate B is decreased, such that both substrates would reach the target thickness at approximately the same time (or if polishing of both substrates halts at the same time, at approximately the same thickness). If the projected endpoint times indicate that the substrates would reach the target thickness at approximately the same time, then no adjustment may be required. By approximately the same time is meant within 2%, e.g., within 1%, e.g., within 0.5% of the total polishing time, or within 5 seconds, e.g., within 2 seconds, e.g., within 1.5 seconds. Likewise, if the projected endpoint thicknesses indicate that the substrates would have approximately the same thickness at the target time, then no adjustment may be necessary. By approximately the same thickness, it is meant that the thickness difference is less than 200 Angstroms.

The polishing rate can be adjusted for various substrates to equalize the polishing time. For example, a reference substrate might be chosen and the processing parameters for all of the other substrates adjusted such that all of the substrates will endpoint at approximately the projected time of the reference substrate. The reference substrate can be, for example, a predetermined substrate, a substrate having the earliest or latest projected time of the substrates, or a substrate having the desired projected endpoint. The earliest time is equivalent to the thinnest substrate if polishing is halted at the same time. Likewise, the latest time is equivalent to the thickest substrate if polishing is halted at the same time. In another implementation, the polishing parameter can be adjusted such that the plurality of substrates reach a target thickness at approximately the average projected time or reach a target time at approximately the average projected thickness for the substrates. In yet another implementation, the target time is simply a predetermined time, e.g., approximately 40 seconds or a predetermined thickness, e.g. approximately 1500-2000 angstroms. The user can select the method of choosing the target time or thickness prior to polishing through the use of a user interface, e.g., the computer receives input from the user selecting which of the plurality of methods of selecting the target time.

The polishing rates can be adjusted by, for example, increasing or decreasing the pressure in a corresponding carrier head. The change in polishing rate can be assumed to be directly proportional to the change in pressure, e.g., a simple Prestonian model. For example, where substrate A is projected to reach the target thickness at a time $T_A$, and the system has established a target time $T_T$, the carrier head pressure before time $T_1$ can be multiplied by $T_T/T_A$ to provide the carrier head pressure after time T1. Additionally, a control model for polishing the substrates can be developed that takes into account the influences of platen or head rotational speed, second order effects of different head pressure combinations, the polishing temperature, slurry flow, or other parameters that affect the polishing rate. At a subsequent time during the polishing process, the rates can again be adjusted, if appropriate.

Figure 4:
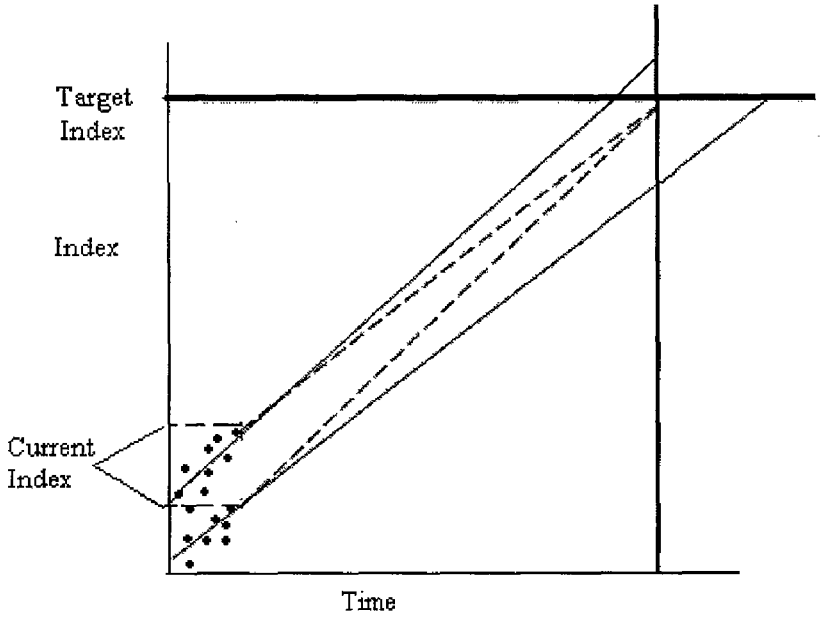
FIG. 4 illustrates an example graph of polishing progress, measured by spectrographic index, for a process in which the polishing rates are adjusted to reach a target time or index.

As shown in FIG. 4, index data gathered with an optical monitoring system can also be plotted according to time and an adjustment made to one or more substrates such that polishing of all of the substrates ends at approximately the same index or time. This system works similar to that of FIG. 3, but the calculations are made using index values rather than thickness values.

Figure 5:
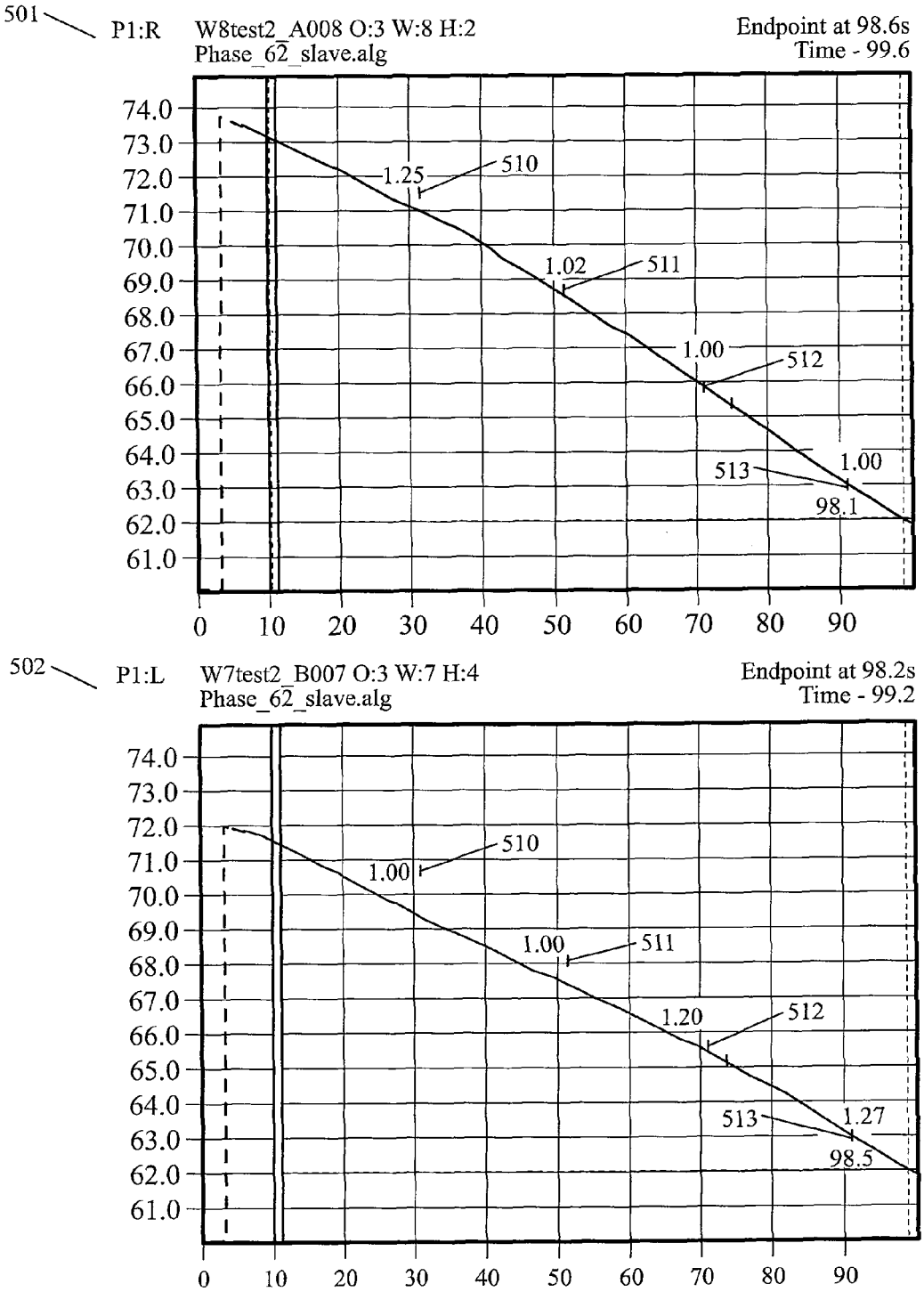
FIG. 5 illustrates two example signal traces, corresponding to two substrates polished on the same platen, from a process in which the polishing rate is adjusted for both substrates.

Referring to FIG. 5, if a particular profile is desired, here a 62% signal level, then the polishing rate, as indicated by signal trace, can be monitored. If the trace of the first substrate 501 and the trace of the second substrate 502 indicate that the two substrates will not endpoint at the same projected time, then the polishing rate of one or both heads can be adjusted.

The process of determining projected times that the substrates will reach the target thickness, and adjusting the polishing rates, can be repeated multiple times during the polishing process, e.g., every thirty to sixty seconds. For example, in FIG. 5, endpoints were predicted at four points during polishing and the polishing pressure was increased for the slower head to speed up polishing. Here, the pressure was multiplied for the first substrate, shown in trace 501, by a factor of 1.25 at 31 seconds (510) and a factor of 1.02 at 51 seconds (511). The pressure was then multiplied for the second substrate, shown in trace 502, by a factor of 1.20 at 70 seconds (512) and a factor of 1.27 at 91 seconds (513). In FIG. 5, the final endpoints of the two substrates were 0.4 seconds apart.

During the polishing process, changes in the polishing rates can be made only a few times, such as four, three, two or only one time. The adjustment can be made near the beginning, at the middle or toward the end of the polishing process.

The method used to adjust endpoints can be different based upon the type of polishing performed. For copper bulk polishing, a single eddy current monitoring system can be used. For copper-clearing CMP with multiple wafers on a single platen, a single eddy current monitoring system can first be used so that all of the substrates reach a first breakthrough at the same time. The eddy current monitoring system can then be switched to a laser monitoring system to clear and overpolish the wafers. For barrier and dielectric CMP with multiple wafers on a single platen, an optical monitoring system can be used.

Embodiments of the invention and all of the functional operations described in this specification can be implemented in digital electronic circuitry, or in computer software, firmware, or hardware, including the structural means disclosed in this specification and structural equivalents thereof, or in combinations of them. Embodiments of the invention can be implemented as one or more computer program products, i.e., one or more computer programs tangibly embodied in an information carrier, e.g., in a machine-readable storage media or in a propagated signal, for execution by, or to control the operation of, data processing apparatus, e.g., a programmable processor, a computer, or multiple processors or computers. A computer program (also known as a program, software, software application, or code) can be written in any form of programming language, including compiled or interpreted languages, and it can be deployed in any form, including as a stand-alone program or as a module, component, subroutine, or other unit suitable for use in a computing environment. A computer program does not necessarily correspond to a file. A program can be stored in a portion of a file that holds other programs or data, in a single file dedicated to the program in question, or in multiple coordinated files (e.g., files that store one or more modules, sub-programs, or portions of code). A computer program can be deployed to be executed on one computer or on multiple computers at one site or distributed across multiple sites and interconnected by a communication network.

The processes and logic flows described in this specification can be performed by one or more programmable processors executing one or more computer programs to perform functions by operating on input data and generating output. The processes and logic flows can also be performed by, and apparatus can also be implemented as, special purpose logic circuitry, e.g., an FPGA (field programmable gate array) or an ASIC (application-specific integrated circuit).

The above described polishing apparatus and methods can be applied in a variety of polishing systems. Either the polishing pad, or the carrier heads, or both can move to provide relative motion between the polishing surface and the substrate. For example, the platen may orbit rather than rotate. The polishing pad can be a circular (or some other shape) pad secured to the platen. Some aspects of the endpoint detection system may be applicable to linear polishing systems, e.g., where the polishing pad is a continuous or a reel-to-reel belt that moves linearly. The polishing layer can be a standard (for example, polyurethane with or without fillers) polishing material, a soft material, or a fixed-abrasive material. Terms of relative positioning are used; it should be understood that the polishing surface and substrate can be held in a vertical orientation or some other orientation.

Particular embodiments of the invention have been described. Other embodiments are within the scope of the following claims.

What is claimed is:

1. A computer-implemented method, comprising:

simultaneously polishing a plurality of substrates in a polishing apparatus, wherein each substrate of the plurality of substrates has a polishing rate independently controllable by an independently variable polishing parameter;

acquiring measurement data from each substrate of the plurality of substrates during polishing with an in-situ monitoring system, wherein the measurement data varies with a thickness of each substrate of the plurality of substrates; and at least one of a) determining a projected thickness that each substrate of the plurality of substrates will have at a target time based on the measurement data and adjusting the polishing parameter for at least one substrate to adjust the polishing rate of the at least one substrate such that the plurality of substrates have closer to the same thickness at the target time than without such adjustment, or b) determining a projected time for each substrate of the plurality of substrates at which the substrate will reach a target thickness based on the measurement data, and adjusting the polishing parameter for at least one substrate to adjust the polishing rate of the at least one substrate such that the plurality of substrates reach the target thickness closer to the same time than without such adjustment.

2. The computer-implemented method of claim 1, wherein determining the projected thickness that each substrate will have at the target time or determining the projected time for each substrate at which the substrate will reach the target thickness includes calculating a current polishing rate.

3. The computer-implemented method of claim 2, wherein acquiring measurement data includes obtaining a sequence of thickness measurements.

4. The computer-implemented method of claim 3, wherein calculating a current polishing rate includes fitting a linear function to the sequence of thickness measurements.

5. The computer-implemented method of claim 4, wherein determining the projected thickness includes extrapolating when the linear function will reach the target time or determining the projected time includes extrapolating when the linear function will reach the target thickness.

6. The computer-implemented method of claim 1, wherein acquiring measurement data includes acquiring measurement data with an eddy current monitoring system.

7. The computer-implemented method of claim 6, further comprising halting polishing upon detection of a polishing endpoint with a laser monitoring system.

8. The computer-implemented method of claim 1, wherein acquiring measurement data includes acquiring measurement data with an optical monitoring system.

9. The computer-implemented method of claim 8, wherein acquiring measurement data includes acquiring a sequence of current spectra of reflected light from the substrate.

10. The computer-implemented method of claim 9, wherein acquiring measurement data further comprises comparing each current spectrum from the sequence of current spectra to a plurality of reference spectra from a reference spectra library and selecting a best-match reference spectra.

11. The computer-implemented method of claim 1, wherein the polishing parameter is a pressure in a carrier head of the polishing apparatus.

12. The computer-implemented method of claim 1, wherein the polishing parameter is a rotation rate of a carrier head of the polishing apparatus.

13. The computer-implemented method of claim 1, wherein the polishing parameter is a rotation rate of a platen of the polishing apparatus.

14. The computer-implemented method of claim 1, wherein adjusting the polishing parameter includes selecting a reference substrate from the plurality of substrates and adjusting the polishing parameter for a different substrate from the plurality of substrates.

15. The computer-implemented method of claim 14, wherein adjusting the polishing parameter of the different substrate adjusts the polishing rate of the different substrate such that the different substrate has approximately the projected thickness of the reference substrate at the target time or such that the different substrate reaches the target thickness at approximately the projected time for the reference substrate.

16. The computer-implemented method of claim 14, wherein selecting a reference substrate includes selecting a predetermined substrate.

17. The computer-implemented method of claim 14, wherein selecting a reference substrate includes selecting a substrate from the plurality of substrates having a thinnest projected thickness of the plurality of substrates or having an earliest projected time of the plurality of substrates.

18. The computer-implemented method of claim 14, wherein selecting a reference substrate includes selecting a substrate from the plurality of substrates having a thickest projected thickness of the plurality of substrates or having a latest projected time of the plurality of substrates.

19. The computer-implemented method of claim 1, wherein adjusting the polishing parameter includes calculating an average thickness from the projected thickness for each substrate of the plurality of substrates or calculating an average time from the projected time for each substrate of the plurality of substrates.

20. The computer-implemented method of claim 19, wherein adjusting the polishing parameter includes adjusting polishing parameters of the plurality of substrates such that the plurality of substrates have approximately the average thickness at the target time or such that the plurality of substrates reach the target thickness at approximately the average time.

21. The computer-implemented method of claim 1, wherein the plurality of substrates are polished at the same platen.

22. A computer program product, tangibly embodied in a computer readable media, comprising instructions for causing a processor to:

cause a polishing apparatus to simultaneously polish a plurality of substrates with each substrate of the plurality of substrates having a polishing rate independently controllable by an independently variable polishing parameter;

receive measurement data from each substrate of the plurality of substrates during polishing with an in-situ monitoring system, wherein the measurement data varies with a thickness of each of the plurality of substrates; and at least one of a) determine a projected thickness that each substrate of the plurality of substrates will have at a target time based on the measurement data and adjust the polishing parameter for at least one substrate to adjust the polishing rate of the at least one substrate such that the plurality of substrates have closer to the same thickness at the target time than without such adjustment, or b) determine a projected time for each substrate of the plurality of substrates at which the substrate will reach a target thickness based on the measurement data, and adjust the polishing parameter for at least one substrate to adjust the polishing rate of the at least one substrate such that the plurality of substrates reach the target thickness closer to the same time than without such adjustment.

23. A polishing apparatus, comprising:

a plurality of carrier heads to hold a plurality of substrates against a polishing surface, each carrier head of the plurality of carrier heads having an independently controllable pressure on a substrate held by the carrier head;

an in-situ monitoring system to generate measurement data from each substrate of the plurality of substrates during polishing, wherein the measurement data varies with a thickness of a substrate being measured; and a controller configured to cause the polishing apparatus to simultaneously polish the plurality of substrates, receive the measurement data, and at least one of a) determine a projected thickness that each substrate of the plurality of substrates will have at a target time based on the measurement data, and adjust the polishing parameter for at least one substrate to adjust the polishing rate of the at least one substrate such that the plurality of substrates have closer to the same thickness at the target time than without such adjustment, or b) determine a projected time for each substrate of the plurality of substrates at which the substrate will reach a target thickness based on the measurement data, and adjust the polishing parameter for at least one substrate to adjust the polishing rate of the at least one substrate such that the plurality of substrates reach the target thickness closer to the same time than without such adjustment.

24. The method of claim 1, comprising determining the projected thickness that each substrate of the plurality of substrates will have at the target time based on the measurement data, and adjusting the polishing parameter for at least one substrate to adjust the polishing rate of the at least one substrate such that the plurality of substrates have closer to the same thickness at the target time than without such adjustment.

25. The method of claim 1, comprising determining a projected time for each substrate of the plurality of substrates at which the substrate will reach a target thickness based on the measurement data, and adjusting the polishing parameter for at least one substrate to adjust the polishing rate of the at least one substrate such that the plurality of substrates reach the target thickness closer to the same time than without such adjustment.

* * * * *

UNITED STATES PATENT AND TRADEMARK OFFICE

CERTIFICATE OF CORRECTION

PATENT NO. : 8,295,967 B2
APPLICATION NO. : 12/267434
DATED : October 23, 2012
INVENTOR(S) : Jimin Zhang It is certified that error appears in the above-identified patent and that said Letters Patent is hereby corrected as shown below:

In Claim 1, line 14 (column 11, line 9), after “data” insert --,--.

In Claim 22, line 17 (column 12, line 55), after “data” insert --,--.

Signed and Sealed this
Twenty-second Day of January, 2013

David J. Kappos

David J. Kappos
*Director of the United States Patent and Trademark Office*